US008998574B2

(12) United States Patent
Menheere et al.

(10) Patent No.: US 8,998,574 B2
(45) Date of Patent: Apr. 7, 2015

(54) SPRING-TENSIONED STATOR RESTRAINING STRAP

(75) Inventors: David Harold Menheere, Georgetown (CA); Richard Ivakitch, Scarborough (CA); Andreas Eleftheriou, Kleinburg (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 841 days.

(21) Appl. No.: 13/223,701

(22) Filed: Sep. 1, 2011

(65) Prior Publication Data

US 2013/0058771 A1 Mar. 7, 2013

(51) Int. Cl.
*F01D 1/02* (2006.01)
*F01D 5/22* (2006.01)

(52) U.S. Cl.
CPC ..... *F01D 5/225* (2013.01); *F05D 2260/30* (2013.01)

(58) Field of Classification Search
CPC ..... F01D 1/02; F01D 5/30; F01D 5/10; F01D 5/225; F04D 29/54; F04D 9/04
USPC ..... 415/189, 190, 191, 209.3
See application file for complete search history.

(56) References Cited

U.S. PATENT DOCUMENTS

| | | | | |
|---|---|---|---|---|
| 4,014,627 | A | 3/1977 | Heurteux | |
| 4,249,859 | A | 2/1981 | Benyi, Jr. et al. | |
| 4,705,454 | A | 11/1987 | Bouiller et al. | |
| 4,859,143 | A | 8/1989 | Larrabee et al. | |
| 4,878,821 | A | 11/1989 | Huether et al. | |
| 4,940,386 | A | 7/1990 | Feuvrier et al. | |
| 5,269,651 | A | 12/1993 | Ostermeir et al. | |
| 5,429,477 | A | 7/1995 | Sikorski et al. | |
| 5,482,429 | A | 1/1996 | Penda | |
| 5,494,404 | A | 2/1996 | Furseth et al. | |
| 6,969,239 | B2 | 11/2005 | Grant et al. | |
| 7,628,578 | B2 | 12/2009 | Barnett et al. | |
| 7,637,718 | B2 | 12/2009 | Barnett et al. | |
| 2010/0237571 | A1 * | 9/2010 | Durocher et al. | 277/631 |

* cited by examiner

*Primary Examiner* — Edward Look
*Assistant Examiner* — Maxime Adjagbe
(74) *Attorney, Agent, or Firm* — Norton Rose Fulbright Canada LLP

(57) ABSTRACT

A vane assembly of a gas turbine engine includes a plurality of circumferentially spaced vanes extending radially between an outer case and an inner case. A spring-tensioned stator restraining strap is provided around the outer case and surrounding outer ends of the respective vanes. The outer ends of the vanes are received in corresponding openings defined in the outer case and project radially outwardly from the outer case. The spring-tensioned strap compresses the respective vanes radially and inwardly in position.

17 Claims, 5 Drawing Sheets

SPRING-TENSIONED STATOR RESTRAINING STRAP

TECHNICAL FIELD

The described subject matter relates generally to gas turbine engines, and more particularly to a stator vane restraining apparatus provided therein.

BACKGROUND OF THE ART

Gas turbine engine vane assemblies, such as those provided downstream of the engine fan, may have slots defined through the outer engine case for receiving and retaining the outer ends of the vanes in place. A grommet may be inserted in the slots to surround and isolate the vane from the shroud. However, during a foreign object damage event, a damaged vane can cut the grommet and cause damage to other surrounding components. An adhesive such as a potting compound is sometimes used, either in conjunction with or as a replacement for the grommet, but the use of such an adhesive generally complicates the installation and replacement of vanes.

Accordingly, there is a need to provide an improved stator vane restraining apparatus for gas turbine engines.

SUMMARY

In one aspect, the described subject matter provides a gas turbine engine comprising an annular casing having a series of circumferentially spaced openings defined therethrough; a plurality of vanes extending radially inwardly though respective casing openings, an outer end of the vanes projecting radially outwardly from the casing through the respective openings, and an inner end of the vanes being mounted to an inner portion of the casing; a strap extending around the annular casing, surrounding and abutting the projecting outer ends of the vanes; and a spring connected to the strap and configured to apply a tension force to the strap.

In another aspect, the described subject matter provides a gas turbine engine having an outer casing surrounding rotating blades of a rotor, the engine further comprising a tubular wall portion of the outer casing located downstream of the rotating blades, the wall portion having a series of circumferentially spaced openings defined therethrough; an inner shroud located inwardly and concentrically with the wall portion, the inner shroud and the wall portion in combination defining an annular flow path therebetween; a vane corresponding with each of the openings, radially extending between the wall portion and the inner shroud, an inner end of the vane being engaged with the inner shroud and an outer end of the vane being received in a corresponding one of the openings, the outer end of the vane projecting radially outwardly from an outer surface of the wall portion; a grommet corresponding to each of the vanes disposed around the outer end of the vane and providing a seal between the outer end of the vane and the tubular wall portion of the outer casing; a strap placed around the tubular wall portion of the outer casing, surrounding and abutting the projecting outer ends of the respective vanes; and a spring ring having opposed end sections connected to respective first and second circumferential locations of the strap, the ring being resiliently deformable under a tensioned condition to apply tensioning forces to the strap in order to cause the strap to radially and inwardly compress the respective vanes in position.

In a further aspect, the described subject matter provides a method of retaining vanes in a gas turbine engine case, the case having a plurality of slots circumferentially distributed therearound, the vanes extending radially through each slot such that an end of the vane projects outwardly from the slot, the method comprising steps of placing a strap around the case to thereby surround and radially abut the vane ends and connecting a spring with the strap to tension the strap when the strap is tightened around the case, thereby causing the strap to radially inwardly compress the respective vanes in position.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

It will be noted that throughout the appended drawings, like features are identified by like reference numerals.

DETAILED DESCRIPTION

Figure 1:
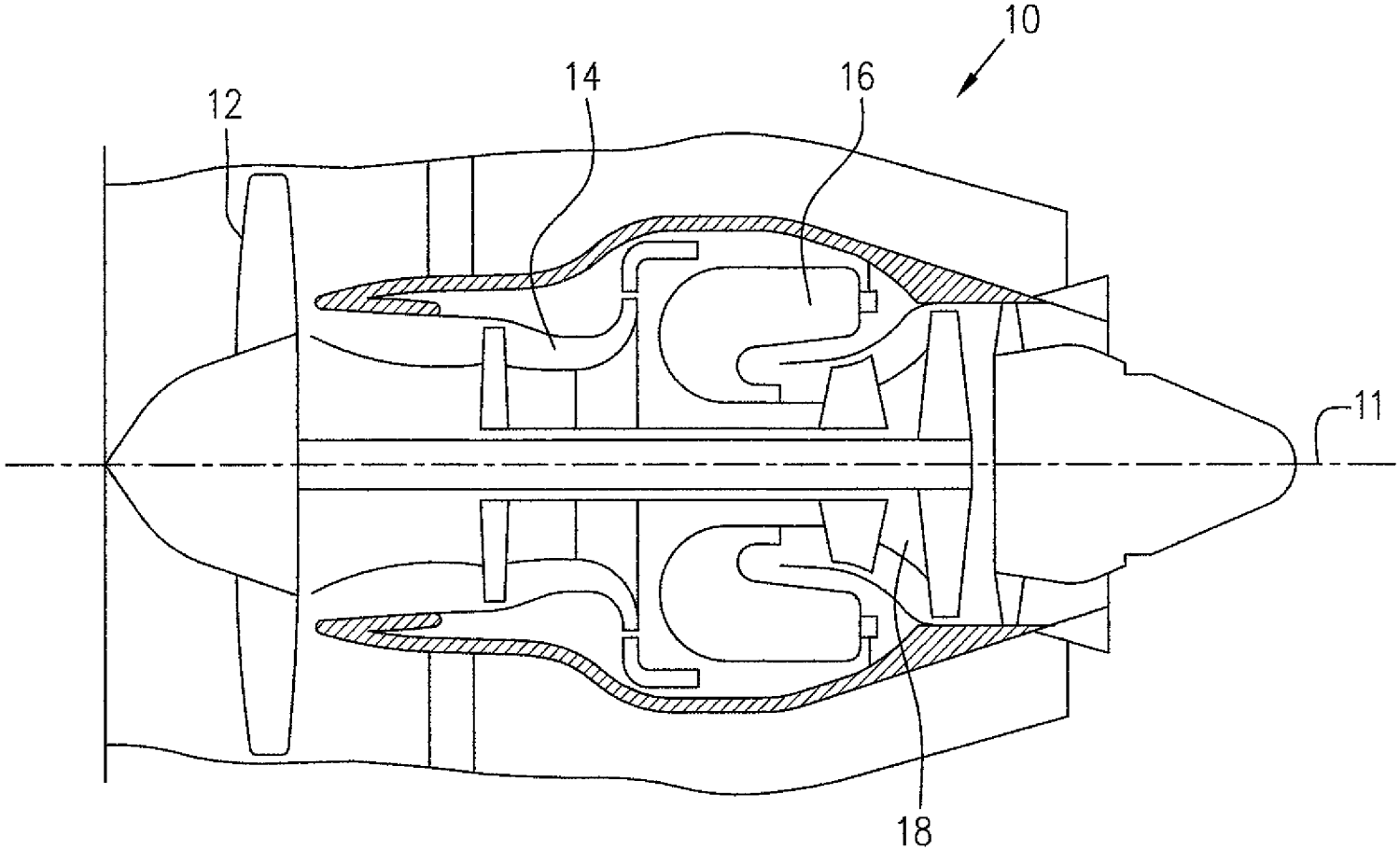
FIG. 1 is a schematic cross-sectional view of a gas turbine engine.

FIG. 1 illustrates a gas turbine engine 10 which is taken as an exemplary application of the described subject matter. The gas turbine engine 10 generally comprises in serial flow communication, a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Rotors of the respective fan 12, compressor section 14 and turbine section 18, rotate about an engine axis 11.

Figure 2:
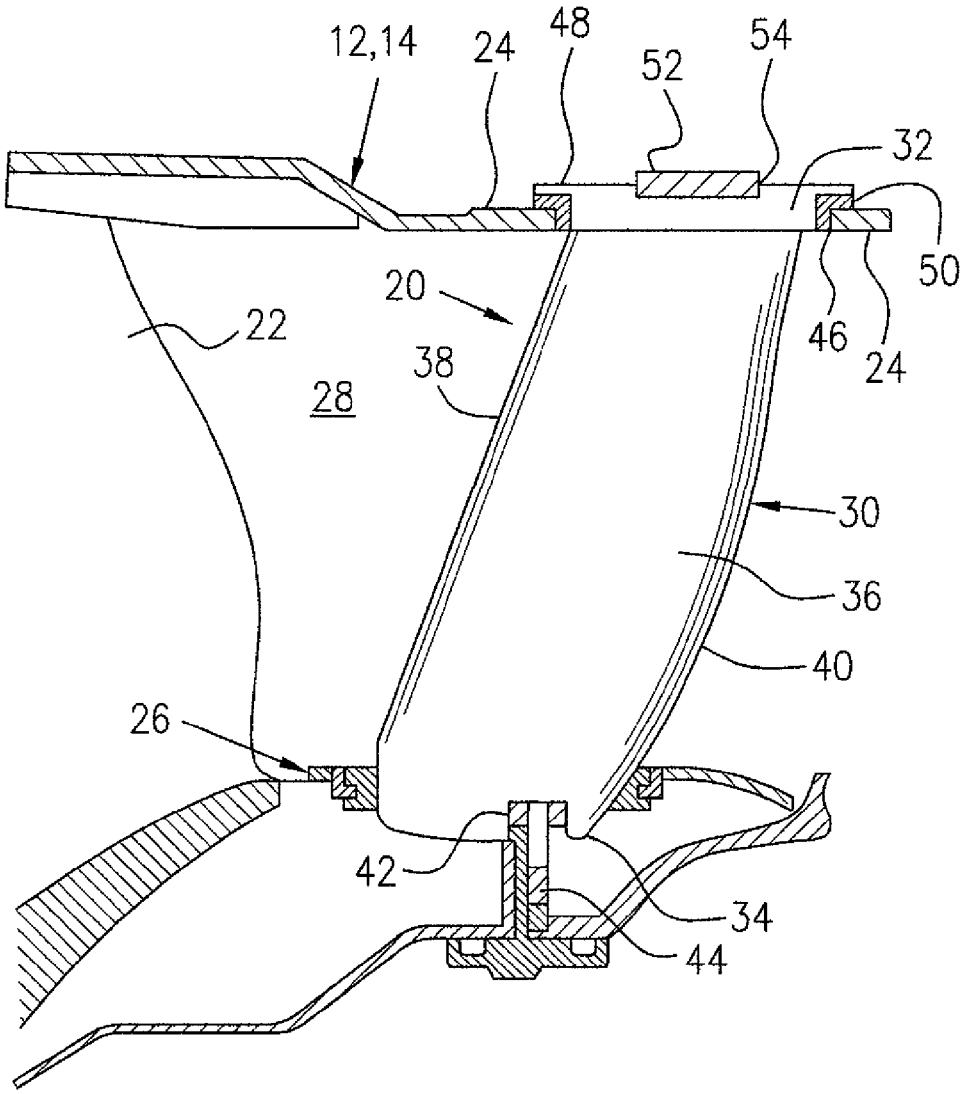
FIG. 2 is a side cross-sectional view of a guide vane assembly according to a particular embodiment, within a gas turbine engine such as that shown in FIG. 1.

Referring to FIG. 2, a rotor assembly, which can be, for example the fan 12 or a low pressure compressor of the compressor section 14 (both shown in FIG. 1), includes rotating blades 22 which are surrounded by an engine casing 24. The casing 24 includes a tubular wall portion (not numbered) extending downstream of the blades 22 to form part of a vane assembly 20. The vane assembly 20 comprises an inner shroud 26 concentric with the casing 24 and located downstream of the rotating blades 22, the inner shroud 26 and casing 24 in combination defining the annular gas flow path 28 therebetween, and a plurality of vanes 30 extending radially between the outer casing 24 and the inner shroud 26 downstream of the rotor blades 22. Each of the vanes 30 has a radial outer end portion forming a vane root 32 retained in the casing 24, a radial inner end forming a vane tip 34 retained in the inner shroud 26, and an airfoil portion 36 extending therebetween. The airfoil portion 36 of each vane 30 defines a relatively sharp leading edge 38 and a relatively sharp trailing edge 40, such that an airflow coming through the blades 22 and passing through the vane assembly 20 will flow over the vane airfoil 36 from the leading edge 38 to the trailing edge 40.

Throughout this description, the axial, radial and circumferential directions are defined respectively with respect to the central axis, radius and circumference of the engine 10.

The vane tip 34 may include a generally rectangular slot 42 extending radially into the airfoil 36 between the leading and trailing edges 38, 40, in order to engage a corresponding web 44 of the inner shroud 26, as disclosed in U.S. Pat. No. 7,413,400, the full description of which is incorporated herein by reference. Alternatively, the vane tip 34 can have any other configuration suitable for engagement with the inner shroud 26.

The outer casing 24 has a series of circumferentially spaced openings 46 defined, for example through the wall portion downstream of the rotating blades 22 of the rotor assembly. Each of the openings 46 has a profile similar to but slightly larger than the vane root 32 such that the vane root 32 is loosely received in the opening 46 and radially and outwardly projects from the outer surface of the outer casing 24.

The vane root 32 includes an end platform 48 having a dimension greater than a dimension of the corresponding opening 46 defined in the casing 24. The end platform 48 may include a circumferential groove 54 which is circumferentially aligned with similar grooves of the remaining vanes 30 in order to receive a restraining strap 52 to fasten and retain the vanes 30 in place within the outer casing 24 of the vane assembly 20.

A plurality of grommets 50 may be provided according to one embodiment, each grommet 50 sealing a gap between the outer end portion of one vane 30 and a corresponding opening 46. The grommet 50 may be for example, an elastic ring having an L-shaped cross-section with one leg inserted into the gap between the vane root 32 and a periphery of the opening 46 in the outer casing 24, and with the other leg placed between an outer surface of the outer casing 24 and an inner surface of the end platform 48 of the vane 30. When the restraining strap 52 is in a tensioned condition to create a radial restraining force on the vane 30, the grommet 50 is compressed by the end platform 48 of the vane 30, against the outer casing 24 to provide a seal therebetween.

Figure 3:
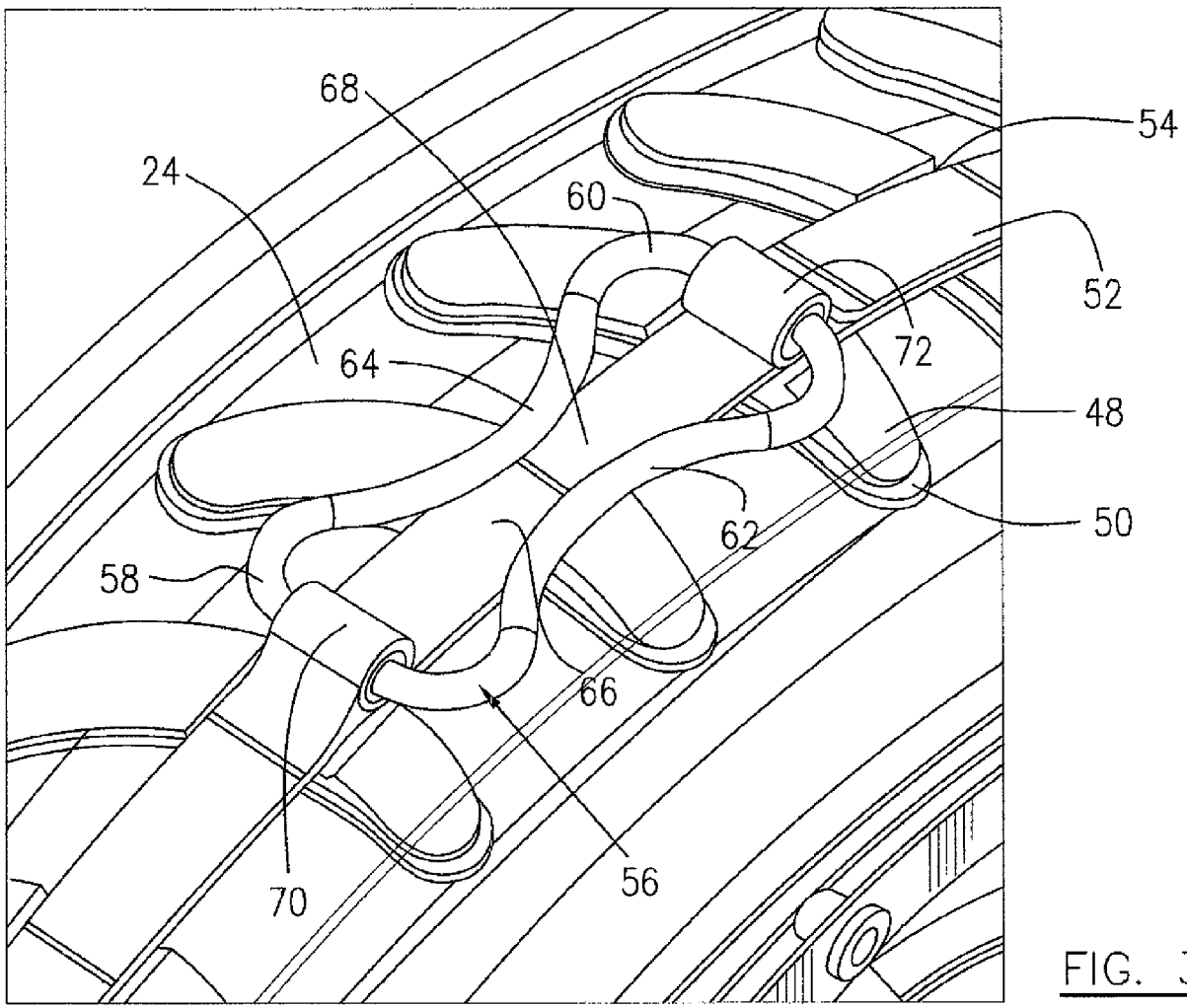
FIG. 3 is a partial perspective view of the vane assembly of FIG. 2, showing a spring tensioned restraining strap in accordance with one embodiment.

Referring to FIGS. 2 and 3, the restraining strap 52 according to one embodiment may be placed around the annular casing 24 and surrounding the projecting outer ends (the end platforms 48) of the respective vanes 30. A spring 56 may be connected to the strap 52 to apply a tensioning force to the strap 52 when the strap is tightened, thereby creating radial forces to compress the respective vanes radially and inwardly in position.

The spring 56 may be formed as a metal ring resiliently deformable when pulling forces are applied to opposed end sections 58, 60 thereof. The ring of the spring 56 may also include two side sections 62, 64 bent inwardly towards each other. The side sections 62 and 64 may define therebetween a dimension smaller than the dimension defined between the opposed end sections 58, 60. Therefore, the spring 56 may form an elongate profiled ring with inwardly curved side sections thereof. The length and curvatures of the side sections 62, 64 of the spring 56, may be determined according to desired tensioning force and permitted circumferential extension under such desired tensioning force. The end sections 58 and 60 of the spring 56 are connected to first and second circumferential locations of the strap 52, such as locations near two respective ends 66, 68 of the strap 52. For example, the end sections 58, 60 of the spring 56 are received in respective loops 70 and 72 which are affixed to the strap 52 near the respective ends 66, 68 thereof. The strap 52 and the loops 70, 72 according to one embodiment, may be made of a metal band and the loops 70 and 72 may be welded or brazed to the metal strap 52. The spring 56 can be used in conjunction with a conventional strap bolt configuration which is known and will not be described herein.

Figure 4:
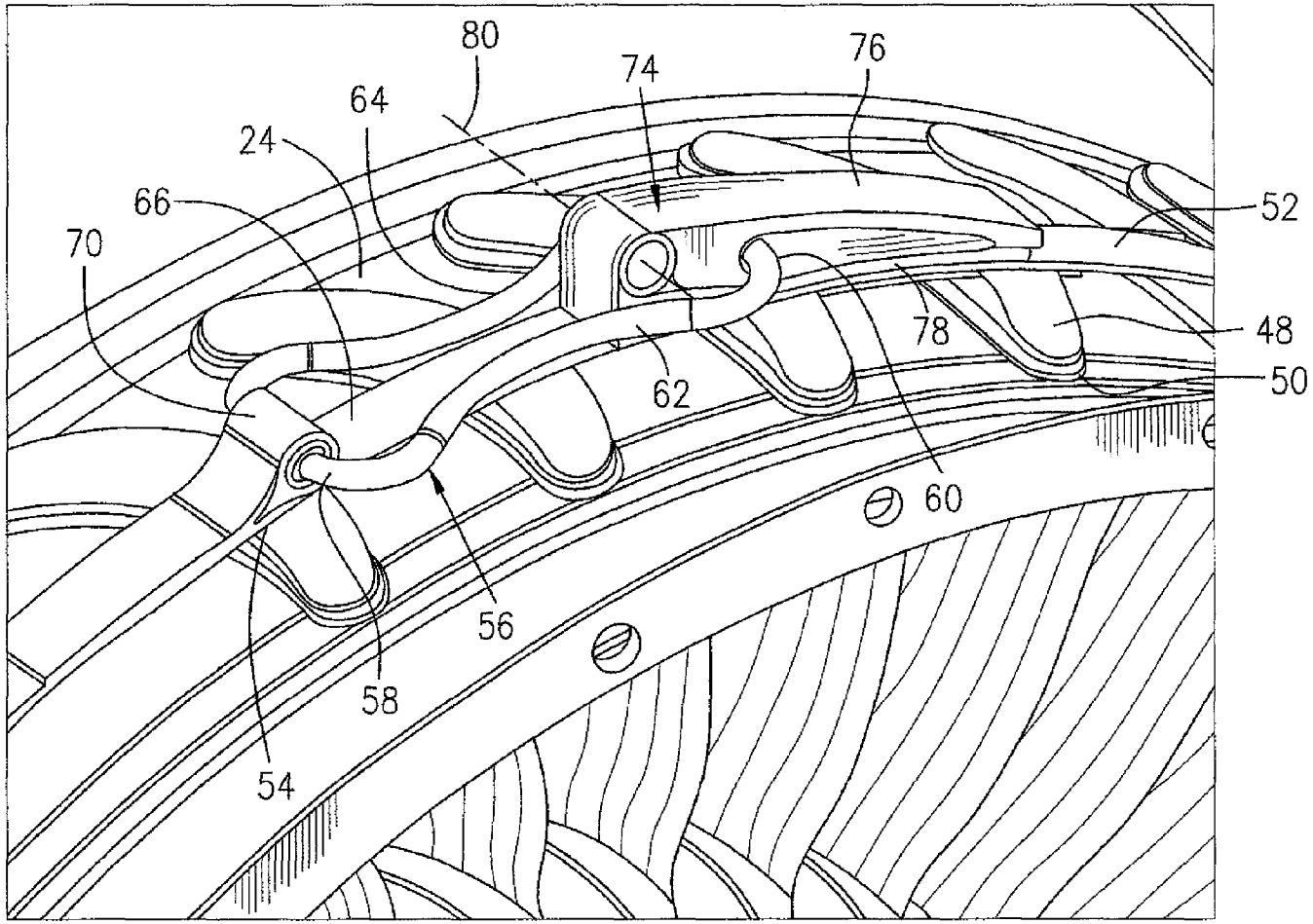
FIG. 4 is a partial perspective view of the vane assembly of FIG. 2, showing a spring tensioned restraining strap with an over-center latch connector in accordance with another aspect.
Figure 5:
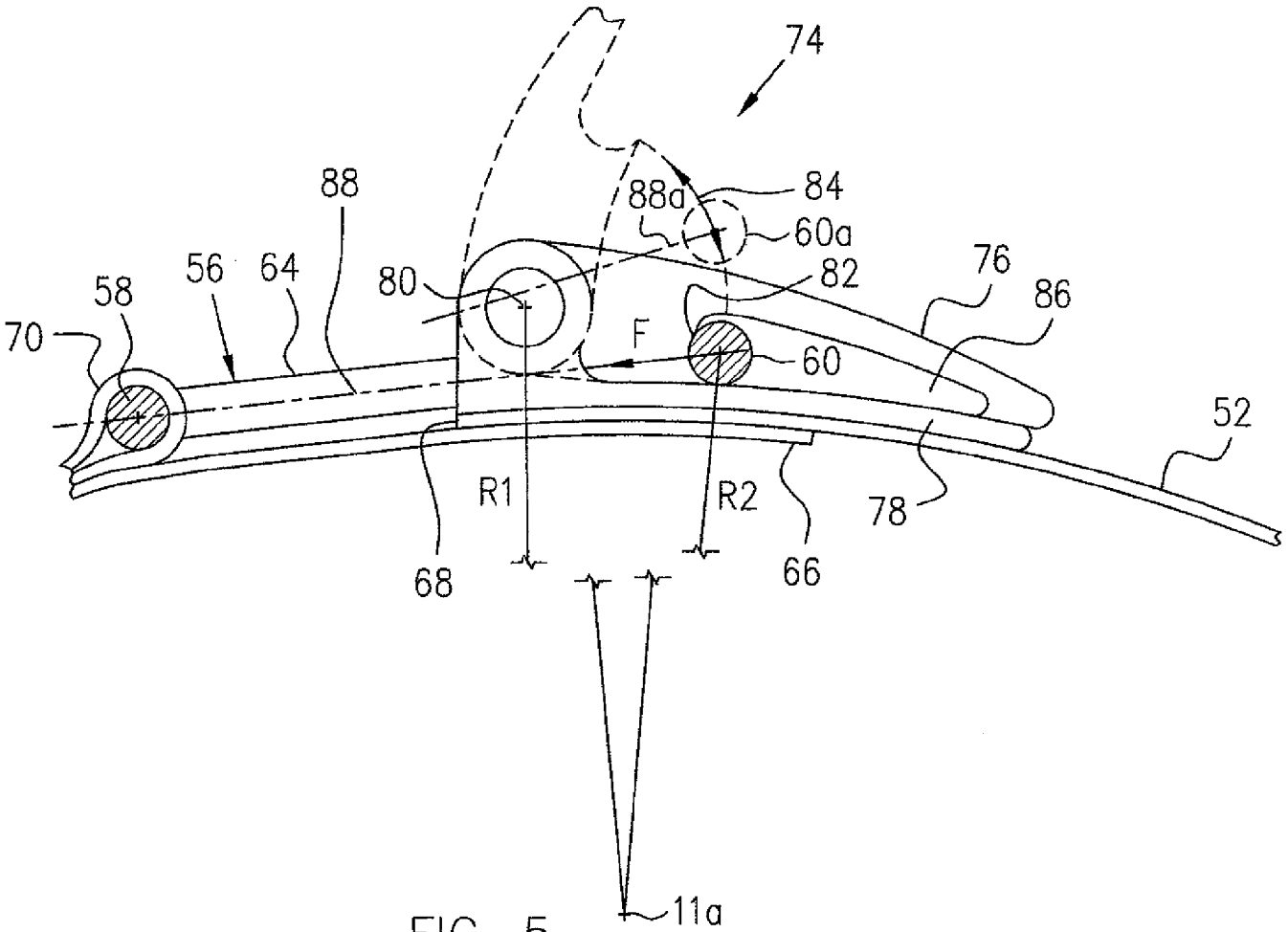
FIG. 5 is a partial side elevational view of the spring tensioned strap of FIG. 4, with a front portion of the spring cut away for best illustration of the over-center latch connector used therewith.

Referring to FIGS. 2, 4-5, the spring 56 may be alternatively used with an over-center latch connector 74 to ease installation of the strap 52. The over-center latch connector 74 according to one embodiment, may include a latch member 76 and a base member 78 affixed for example by welding or brazing to the strap 52 at a location near the end 68 thereof. The latch member 76 is pivotally connected to the base member 78 at the respective ends thereof about a pivotal axis 80 and defines a hook 82 for receiving the end section 60 of the spring 56 when the spring 56 is connected to the over-center latch connector 74. The latch member 76 is pivotable as indicated by bi-directional arrow 84, between an open position (as shown in broken lines) to allow the end section 60 of the print 56 to be placed in or removed from the hook 82 of the latch member 76, and a closed position in which the end section 60 of the spring 56 is received within a slot 86 defined radially between the base member 78 and the latch member 76 and extending circumferentially between the hook 82 and a free end (not numbered) of the latch member 76.

The over-center latch connector 74, the spring 56 and the strap 52 are designed such that the strap 52 placed around the tubular wall portion of the outer casing 24 (see FIG. 4) is in a tensioned condition because the end section 60 of the spring 56 is seated in the hook 82 of the latch member 76 which is in the closed position, and thus is pulled away from the end section 58 of the spring 56. The spring 56 is therefore stretched to create a tensioning force F acting on the hook 82 of the latch member 76 (see FIG. 5). The tensioning force F acting on the over-center latch connector 74 which is affixed to the strap 52, maintains the strap 52 in such a tensioned condition.

It should be noted that a radial distance R1 between the pivotal axis 80 of the over-center latch connector 74 and a central axis 11*a* of the tubular wall portion of the outer casing 24 which substantially superposes the engine central axis 11 (see FIG. 1), according to one embodiment, may be greater than a radial distance R2 between a central point of the end section 60 and the central axis 11*a* of the tubular wall portion of the outer casing 24. Therefore, the tensioning force created by the spring 56 and acting on the hook 82 of the latch member 76 which is in the closed position, is directed along a tensioning force line 88 positioned below the pivotal axis 80, which causes the latch member 76 to rotate about the pivotal axis 80 in a clockwise direction, thereby locking the latch member 76 in the closed position. A lift up force must be applied to the latch member 76 to pivot the latch member 76 together with the end section 60 of the spring 56 in the anti-clockwise direction in order to release the spring 56 from the tensioned condition because the spring 56 will be further stretched when the latch member 76 is pivoted in the anti-clockwise direction and end section 60 of the spring 56 is moved up to a position as indicated by broken lines 60*a* in which until the tensioning force line 88 is positioned above the pivotal axis 80 as indicated by line 88*a* in FIG. 5. The closed position of the over-center latch connector 74 is therefore a self-locking position for locking the spring 56 and thus the strap 52 in the tensioned condition.

The two ends 66, 68 of the strap 52 may be spaced slightly apart in the circumferential direction as shown in FIG. 3 when installed in position under the tensioned condition. Alternatively, the two ends 66, 68 of the strap 52 may be disposed to overlap each other when the strap is in the tensioned condition, as shown in FIG. 5 in order to ensure that every vane 30 is compressed by the tensioning straps 52.

The spring 56 in the elongate profiled ring has a very low installed profile in contrast to other spring tensioners, which is an added benefit, particularly in aircraft gas turbine engines. The spring 56 of the elongate profiled ring maintains its tension over a relatively large range of displacement, in contrast to other types of spring tensioners.

The above description is meant to be exemplary only, and one skilled in the art will recognize that changes may be made to the embodiments described without departure from the scope of the described subject matter. For example, the described subject matter may be applicable to gas turbine engines other than the illustrated turbofan gas turbine engine and the fan assembly may be configured differently from the fan assembly described and illustrated herein. Still other modifications which fall within the scope of the described subject matter will be apparent to those skilled in the art, in light of a review of this disclosure, and such modifications are intended to fall within the appended claims.

The invention claimed is:

1. A gas turbine engine comprising:

an annular casing having a series of circumferentially spaced openings defined therethrough;

a plurality of vanes extending radially inwardly through respective casing openings, an outer end of the vanes projecting radially outwardly from the casing through the respective openings, and an inner end of the vanes being mounted to an inner portion of the casing;

a strap extending around the annular casing, surrounding and abutting the projecting outer ends of the vanes; and a spring including a ring having opposed end sections connected to first and second circumferential locations of the strap, respectively, the ring including two side sections defining therebetween a dimension smaller than a dimension defined between the opposed end sections, the ring thereby being resiliently deformable when pulling forces are applied to the opposed end sections of the ring.

2. The engine as defined in claim 1 comprising a connector attached to the strap for releasably connecting the spring in a tensioned condition.

3. The engine as defined claim 1 wherein the ring comprises two side sections bent inwardly towards each other.

4. The engine as defined in claim 1 wherein one end section of the ring is affixed to the first circumferential location of the strap and the other end section of the ring is releasably connected to the second circumferential location of the strap by means of a connector.

5. The engine as defined in claim 2 wherein the connector comprises a base member affixed to the strap and a latch member pivotally connected to the base member for releasably securing the spring in the tensioned condition.

6. The engine as defined in claim 5 wherein the latch member comprises a hook for receiving an end of the spring.

7. The engine as defined in claim 5 wherein the latch member is pivotable with respect to the base member, between an open position and a closed position which is self-locking when the spring is releasably secured by the latch member under the tensioning force.

8. The engine as defined in claim 5 wherein the latch member is pivotable about a pivotal axis, a radial distance between a central axis of the annular casing and the pivotal axis being greater than a radial distance between the central axis of the annular casing and a central point of an end of the spring secured by the latch member when the latch member is pivoted to a self locking position.

9. The engine as defined in claim 1 comprising a plurality of grommets, each grommet sealing a gap between the outer end of one vane and a corresponding opening in the annular casing.

10. The vane assembly as defined in claim 1 wherein the strap is metal.

11. A gas turbine engine having an outer casing surrounding rotating blades of a rotor, the engine further comprising:

a tubular wall portion of the outer casing located downstream of the rotating blades, the wall portion having a series of circumferentially spaced openings defined therethrough;

an inner shroud located inwardly and concentrically with the wall portion, the inner shroud and the wall portion in combination defining an annular flow path therebetween;

a vane corresponding with each of the openings, radially extending between the wall portion and the inner shroud, an inner end of the vane being engaged with the inner shroud and an outer end of the vane being received in a corresponding one of the openings, the outer end of the vane projecting radially outwardly from an outer surface of the wall portion;

a grommet corresponding to each of the vanes disposed around the outer end of the vane and providing a seal between the outer end of the vane and the tubular wall portion of the outer casing;

a strap placed around the tubular wall portion of the outer casing, surrounding and abutting the projecting outer ends of the respective vanes; and a spring ring having opposed end sections connected to respective first and second circumferential locations of the strap, the ring including two side sections extending between the opposed end sections and being bent inwardly towards each other, the ring thereby being resiliently deformable under a tensioned condition to apply tensioning forces to the strap in order to cause the strap to radially and inwardly compress the respective vanes in position.

12. The engine as defined in claim 11 wherein a first end section of the ring is affixed to the first circumferential location of the strap and a second end section of the ring is releasably connected to the second circumferential location of the strap by means of a connector.

13. The engine as defined in claim 12 wherein the connector comprises a base member affixed to the strap and a latch member pivotally connected to the base member, the latch member being pivotable between a first position for receiving or releasing the second end section of the spring ring and a second position for locking the spring ring in the tensioned condition.

14. The engine as defined in claim 12 wherein the connector comprises a base member affixed to the strap and a latch member pivotally connected to the base member, thereby defining a pivotal axis, a radial distance between a central axis of the tubular wall portion and the pivotal axis being greater than a radial distance between the central axis of the tubular wall portion and a central point of the second end of the spring ring locked by the latch member in the tensioned condition.

15. The engine as defined in claim 11 wherein the strap is metal and comprises two ends overlapping each other when the strap is in the tensioned condition.

16. A method of retaining vanes in a gas turbine engine case, the case having a plurality of slots circumferentially distributed therearound, the vanes extending radially through each slot such that an end of the vane projects outwardly from the slot, the method comprising steps of placing a strap around the case to thereby surround and radially abut the vane ends and connecting a spring with the strap to allow the spring to be substantially in line with the strap, and to tension the strap when the strap is tightened around the case, thereby causing the strap to radially inwardly compress the respective vanes in position.

17. The method as defined in claim 16 wherein the step of connecting the spring with the strap is achieved by connecting opposed end sections of a resilient deformable ring to first and second circumferential locations of the strap.

* * * * *